United States Patent [19]

Armitage et al.

[11] Patent Number: 4,575,256

[45] Date of Patent: Mar. 11, 1986

[54] RAGLESS PROPELLER DRAFT TUBE MIXER

[75] Inventors: Jack R. Armitage, Kearns; Ralph B. Haymore, Salt Lake City, both of Utah

[73] Assignee: Envirotech Corporation, Salt Lake City, Utah

[21] Appl. No.: 533,831

[22] Filed: Sep. 19, 1983

[51] Int. Cl.[4] ..... B01F 5/12

[52] U.S. Cl. ..... 366/266; 366/323; 415/213 C; 416/176

[58] Field of Search ..... 366/262, 264, 266, 270, 366/265, 279, 318, 323; 415/213 C, 72, 73; 416/176, 177; 308/187, 187.1

[56] References Cited

U.S. PATENT DOCUMENTS

| | | | |
|---|---|---|---|
| 658,678 | 9/1900 | Roseborough | 416/176 |
| 1,015,540 | 1/1912 | Butow | 416/176 |
| 1,498,783 | 6/1924 | Clark | 416/176 |
| 2,038,221 | 4/1936 | Kagi | 366/266 |

*Primary Examiner*—Robert W. Jenkins

*Attorney, Agent, or Firm*—Thomas S. MacDonald; Alan H. MacPherson; Carl Rowold

[57] ABSTRACT

A draft tube mixer is disclosed particularly adapted for use with digestion processes and apparatus wherein a vertical shaft (13) is driven by motor (15) through a suitable drive (14) to rotate a ragless propeller (12). The propeller (12) has a series of three lobes or blades (40–42) which are concentrically arranged at 120° apart positions so that the minimum diameter of the blades are at the ends of a hub (43) from which the blades integrally extend. The blades extend over the length of the hub over about a 360° of rotary motion. The blades (40–42) are symmetrical from their ends to the mid points on the vanes from either direction top or bottom so that the propeller is reversible without loss of efficiency. The leading edge (50) of each of the blades regresses from a point from the start of the blade progression tangent to the outside of the hub at each end so that this falling away of the angle of attack of the blade causes any debris striking the blade, such as rags or string to fall away outwardly of the blade hub so that it does not ball up or otherwise adhere to the hub area.

1 Claim, 9 Drawing Figures

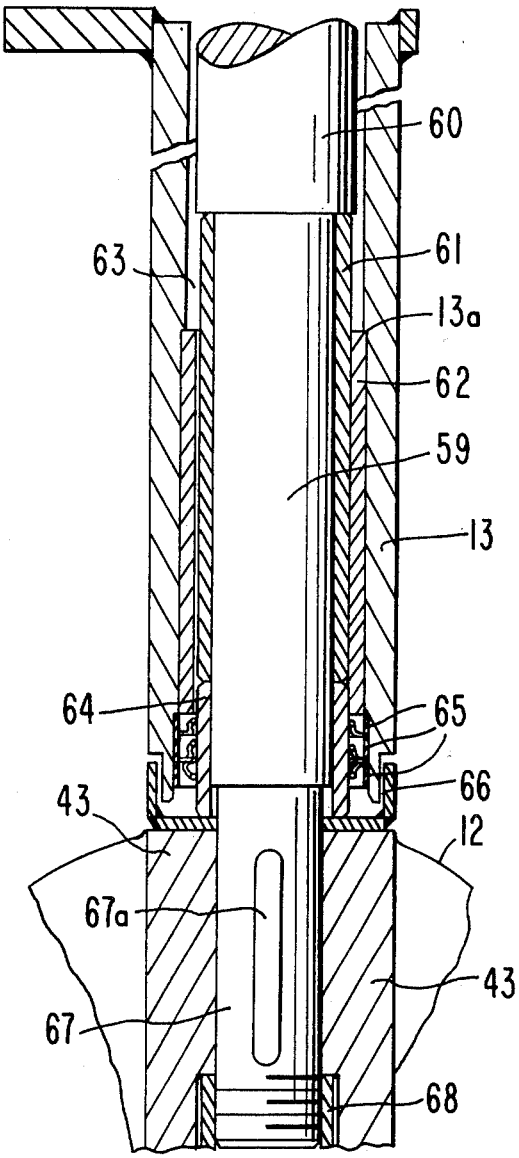
FIG. 7
FIG. 8
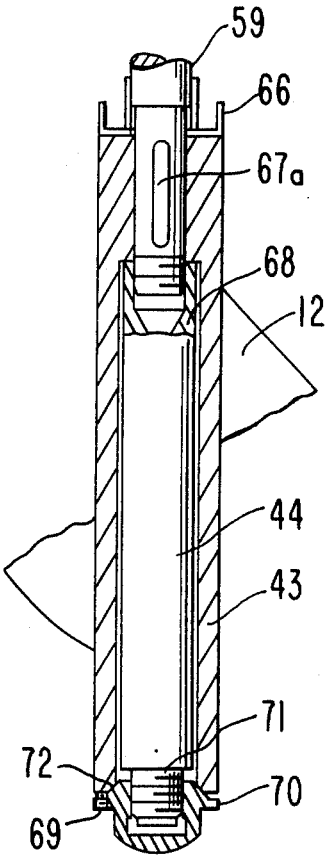
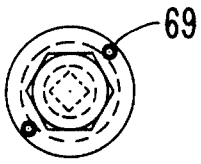
FIG. 9

RAGLESS PROPELLER DRAFT TUBE MIXER

BACKGROUND OF THE INVENTION

1. Field of the Invention

The present invention generally relates to a draft tube-type mixer including a propeller which pumps relatively large volumes of sludges or slurries and is positioned generally within or without a tank. In the case of anaerobic digestion of sewer sludges, these mixers act as low head, high volume sludge pumps and utilize a motor to drive a vertically-oriented sludge mixing propeller.

2. Description of the Prior Art

Draft tube mixers per se have been constructed and used for various applications, including high rate digestion processes, for many years. These devices include a draft tube(s) positioned within a digestion or other tank, which has a vertically mounted marine-type propeller or other paddle-like mixing vanes rotable with a vertical shaft driven by a motor. The motor and propeller are normally uni-directional in operation i.e. pumping either upwardly or downwardly. Prior art motors are sometimes reversible in order to try to "clear" or flush-off a propeller which has become fouled from rags, string or other debris or to put a marine vehicle in reverse. In reverse there is normally a large sacrifice in efficiency. The propellers used in most cases were designed for clean water use and have relatively short hub lengths. The construction is such as to cause unwanted materials (e.g. string and rags) which enter onto the inner 85–90% of the blade height to move toward the propeller hub. This results in those materials wrapping around the hub in a large ball. This increases the blade leading edge causing a reduction in pumpage and an increase in power draw. When the propeller is reversed it has been found that not much of the unwanted materials actually flushes off. Various marine-type propellers have two or more lobes or blades which have a root tracing a spiral or helical generatrix along a horizontal shaft hub. These are seen in U.S. Pat. Nos. 543,909 with uniform width blades; 1,015,540 with bifurcated ends; 1,307,106 with ends only attached to a shaft; 1,498,783 with an ichthyoidal hub profile; and 1,892,182 with concave/convex blade faces to direct water to the center of the propeller.

The problem of protecting pumps from rags and other unwanted material has also been solved to some degree by using recessed impellers. Such pumps however are not efficient in pumping the large volumes needed in draft tube mixers and do not perform satisfactory mixing.

SUMMARY

The present invention provides a draft tube mixer having an improved propeller which precludes accumulation of debris such as rags or string around the propeller blades or hub. The propeller design permits forward and reverse motor operation. The normally vertically mounted symetrical propeller is rotated either in a clockwise or counter-clockwise direction to pump fluid from the bottom to the top of the draft tube or vice versa with equal efficiency. The draft tube and propeller provides for low head loss and effective utilization of mixing energy. In use with anaerobic digestion, effective sludge mixing is provided with strong surface agitation to effect scum break-up. The high degree of mixing intensity effectively eliminates short circuiting and increases the active digester volume.

These improvements are accomplished by providing a preferably three-lobed pump having warped blades in which the leading edge "falls away" or regresses from its point of tangency with the propeller hub so that any debris striking the blades falls away outwardly of the blade hub and rags, string or other debris cannot ball up on the hub.

The propeller of this invention can be any pitch with any diameter. It may be a so-called square propeller having the same diameter as length or have a longer hub than diameter. The blades of the invention are symmetrical from the top to the lengthwise center-line and from the bottom to the lengthwise center-line so that they are mirror-images of each other and have equal efficiency in either direction of rotation without losing pumping capacity. The preferred embodiment of the propeller is cast so as to avoid any protruberances or structures on which debris can be snagged, which would be existent in bolted or welded structures. Casting allows for a stronger and cleaner design where the blade root areas are blended or faired into the hub.

A further feature of the improved draft tube mixer is an oil column lubricated lower bearing for the propeller shaft. Conventional mixers are equipped with lower bearings which are mounted either just above liquid level or submerged just above the propeller level and are grease lubricated or sludge lubricated. Digesters operate at pressures greater than atmospheric pressure. The pressure within the shaft shield is atmospheric. The tank internal pressure from the digester gas is constantly trying to force the sludge through the lower seals into the bearing. The sludge is very gritty. This grit combined with water flushing the grease out of the bearing will cause the destruction of the bearing in a short period of time. Having the bearing above the liquid level causes bearing construction problems and necessitates a long cantilevered shaft. The present invention provides a bearing located adjacent to the propeller for best support, and provides a pressure inside the shaft shield which is always greater than that in the mixing area due to a high column or head of oil. The internal oil pressure head is greater than the pressure on the outside of the mixer; thereby making it almost impossible for the sludge to enter through the seals to the bearing area. The bearing is submerged in oil all the time with minimal chance that sludge water can flush it out. A further feature of the invention is that the shaft shield is a smooth pipe from a flange above liquid level down to the propeller. This eliminates any possibility of rags and strings building up on the shaft and interfering with the pumpage rate. In contrast, most other draft tube mixers have flanges with associated bolts and grease lines below liquid level, which make ragging a real problem. Lastly, an improved means to connect the propeller to the shaft hub is disclosed for locking the propeller radially, axially and torsionally on the shaft.

BRIEF DESCRIPTION OF THE DRAWING

FIG. 7 is a partial cutaway cross-sectional elevation view of the lower bearing for the propeller shaft.

FIG. 8 is a partial cutaway cross-sectional elevation view of the propeller hub and propeller-to-shaft locking means.

FIG. 9 is a bottom end view of the locking means of FIG. 8.

DETAILED DESCRIPTION

The present invention finds particular utility in the mixing of sludges in anaerobic sludge digestion processes. Effective digester mixing enhances the anaerobic digestion process, while inadequate or improper mixing causes difficulties such as reduced rates of volatile solids destruction, gas production, rapid scum accumulation and foaming. Thickening of sludges to be anaerobically digested has become a common practice. Combining sludge thickening with adequate digester mixing reduces the volume required for effective digestion and makes the process less subject to upset. Digesters normally comprise cylindrical tanks have a fixed digester cover thereover. Bouyant covers are also utilized which are designed to move vertically thus allowing large liquid level variations. Sludge mixers are vertically oriented devices which may be mounted so they depend from the digester cover or they may be in flow communication with the tank interior through appropriate flow conduits through the vertical walls of the digester tank so as to move and mix slurry liquor from the bottom to the top or vice versa in the digester tank. Multiple mixers may be used in one digester if necessary to give satisfactory mixing.

When tank contents are not vigorously mixed, stratification may occur and the tank volume is not effectively utilized. The sludge mixers of this invention minimize scum formation, distribute heat more evenly throughout the digester, completely mix the digester contents and evenly distribute volitile acids assets and nutrients. These mixers act as low-head, high volume sludge pumps utilizing especially designed vertical sludge mixing propellers which may operate in either direction maximizing system flexibility. The propellers prevent fouling and preclude accumulation of debris in the mixer.

Figure 1:
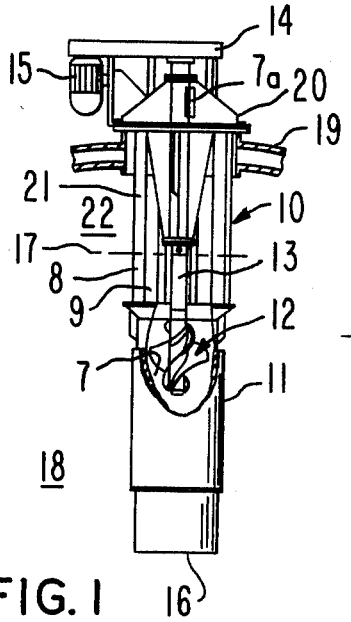
FIG. 1 is a partially cutaway side elevation view of an upward or downward discharging draft tube mixer depending from a digester tank cover.

As seen in FIG. 1 the draft tube mixer 10 comprises a cylindrical draft tube 11 which depends into the fluid level 17 in a fluid-holding tank (not shown). The propeller 12 of the invention depends from the interior of a shaft housing 13 and is attached to a propeller shaft which is connected to belt-driven pulley subsystem 14 rotated by a reversible motor 15. In most applications the motor is an explosion proof motor rated from about 5 to 20 horsepower and is designed to pump up to about 20,000 gallons per minute. The mixer assembly 10 is shown mounted by suitable platform means 20 in an aperture at the top or other location in a digester cover 19. The propeller 12 and an inlet or outlet extension 16 of the draft tube is positioned within the fluid 18 to be pumped below fluid level 17. The propeller of this invention in conjunction with the draft tube prevents accumulation of scum in the volume 22 above the fluid level 17 and the tank cover 19. Propeller 12 may be operated in either clockwise or counterclockwise direction so that the inlet 16 may function as 1) an outlet with the fluid being conveyed downwardly by pump suction from upper fluid levels in the tank, through vertical apertures 9 in a cage 8 supporting draft tube 11 in depending relation from platform 20, down through the propeller and draft tube or 2) as an inlet with fluid flow in the "up" direction through tube 11 and propeller 12. Operation of the propeller may be over a wide RPM range dependent on application. In a digester process use, a preferred range is from about 200 to about 400 RPM.

Figure 2:
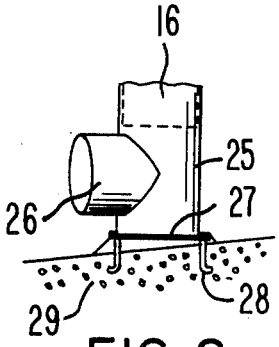
FIG. 2 is a side elevation view of the bottom of tangentially discharging mixer.
Figure 3:
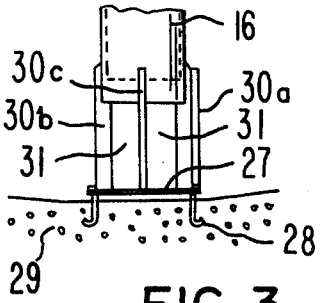
FIG. 3 is a side elevation view of the bottom of a radially discharging mixer.

As can be seen in FIGS. 2 and 3 the discharge from outlet 16 may typically be tangentially through an extension 25 and exit portion 26 or through a series of vertical apertures 31 extending between vertical rails 30 *a, b* and *c*. The rails mount the draft tube outlet 16 to the bottom 29 of the digester tank by means of a deflector platform 27 held by embedded bolts 28 in the digester bottom.

Figure 4:
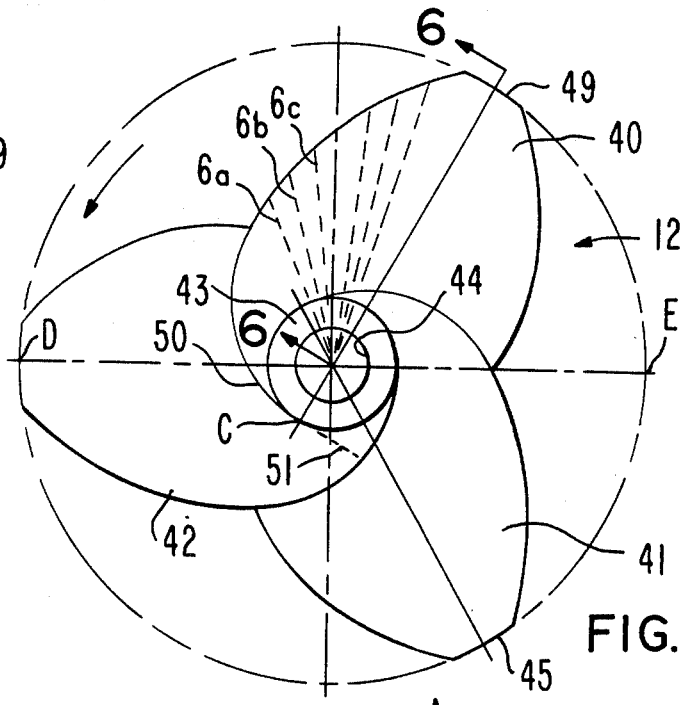
FIG. 4 is a top view of the ragless propeller of this invention.
Figure 5:
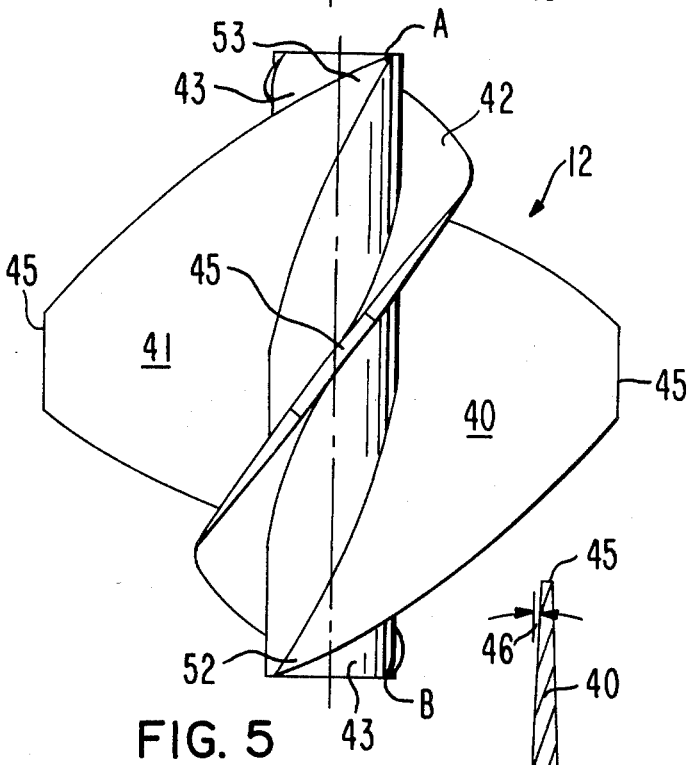
FIG. 5 is a side elevation view of the propeller of FIG. 4.

The propeller of this invention is seen in detail in FIGS. 4 and 5. Referring to FIG. 4 the propeller contains three lobes 40, 41 and 42 mounted on a propeller hub 43 which contains a central bore 44 to receive a suitable propeller drive shaft. Each of the lobes 40-42 are faired into the hub and have minimum blade diameters at the extremities of the hub at a first position as a point A in FIG. 5 and extends at varying diameter the length of the hub to be faired in at a third position (point B) at the opposite end also at minimum blade diameter. Each of the lobes are positioned one hundred twenty degrees (120°) around the hub 43 as they spiral around the hub and have a maximum diameter at a second position at the mid-point between points A and B on the hub. As can be seen in FIG. 4 leading edge 50 of lobe 40, for example, sweeps back or regresses from its point of tangency C at its point of attachment or start on shaft 43. Tangent 51 forming point C is at right angles to a radial line at that point through the center of bore 44. The regressing blade leading edge 50 functions to mechanically force any solid or stringy material or other debris away from hub 43. The radial lines 6*a, b, c,* etc., further illustrate the regression of the leading edge. Any stringy or solid material will move toward the tip of the blade and is flushed off. Natural centrifugal forces also removes material from the propeller blades. Unlike the normal marine propeller there is no leading edge ahead of the point where contact is made on the blade to stop outward movement away from the hub.

While the invention has been described in terms of a preferred three-lobed propeller, the lobe numbers may be variable in quantity. The lobes of the propeller are cast integrally with the hub 43 so that there are no obstructions or nicks or protrubrances on which debris may catch or entwine.

As can be seen more clearly in FIG. 5 the blades are symmetrical as one progresses from point A to the mid point between points A and B. Likewise the blades are symmetrical from point B to the mid point between points A and B. This construction is also clearly shown by the propeller 12 in FIG. 1. Each of the blades have a flat 45 at their exterior periphery adjacent their position at essentially the mid point of hub 43 and at maximum blade diameter to provide for sufficient clearance with the inside surface 7 of draft tube 11 (FIG. 1). The face and backside of each blade is identical thus there is no change in efficiency when the propeller is rotated in either direction and used to pump in either up or down direction.

The blades have a higher pitch close to the hub than at the blade tip. This difference in pitch produces a plug flow through the propeller, i.e., for one revolution of the propeller, a particle being pumped at the blade tip will move axially the same amount as a particle being pumped at the hub.

The propeller of FIG. 5 has a length from point A to point B generally equal to the diametrical width between the tips 45 of the blades 40 and 42 radially across the propeller, i.e., from Point D to Point E. Thus the propeller illustrated is of the so called "square" type wherein the length and diameter are essentially equal. In its preferred embodiments the propeller is 24" diameter and 24" long (hub length) or 36" diameter and 36" long. In other embodiments the propeller blades extend over a two to three feet extent of the hub length or axis but have a smaller diameter, for example 18 inches. These relatively long propeller heights mean that rags under 24" (or 36" in the latter cases) cannot extend from one leading edge to the other and will not wrap around the propeller from top to bottom. Few rags or pieces of debris are longer than 24" in length. Having a long propeller hub of the order of about two feet to about three feet tends to prevent fibrous material from hanging on to the propeller. Fibrous material could only hang on to the propeller of this invention if it were to catch on a nick on the leading edge of the blade and then wind itself around the blade and hub until it came to the trailing edge of the blade. There would also have to be a nick in the trailing edge for the fiber to be caught in or when the propeller is stopped turning, the water continuing past the blade would wash it off.

Figure 6:
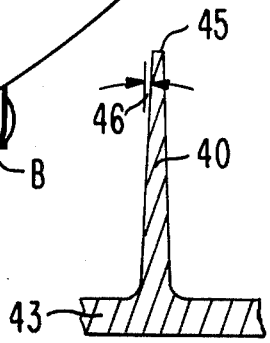
FIG. 6 is a section of a propeller lobe taken on the line 6—6 of FIG. 4 which has been rotated 90° CCW.

FIG. 6 is a cross-sectional view of the blade 40 taken at its mid point. It extends integrally with hub 43 to the flat 45 at its outer periphery at the mid point of the blade length. The blade has a taper 46 extending from its root portion to its tip portion.

A further important feature of this invention is the provision of a special bearing configuration. The mixer upper bearing (not shown) is conventional and is located well above liquid level next to the motor. An oil lubricated lower bearing is provided adjacent the propeller and prevents ingress of digester or other material into the propeller bearing. Using this configuration bearing span is increased and overhung loads are negligible resulting in extended bearing life.

The shaft housing 13 (FIG. 7) contains a rotating shaft 60 pulley connected to the driving motor as shown in FIG. 1. A shaft extension 59 integral with shaft portion 60 extends to a key shaft 67 containing a keyway 67*a* for attachment of propeller hub 43. A steel wear sleeve 61 surrounds the shaft extension 59 and plastic bearing (which may be of a high density high molecular weight material) or bronze bearing sleeve 62 concentrically surrounds the wear sleeve. The plastic bearing is vertically held by a ridge 13*a* on the interior periphery of shaft housing 13. A column of oil 63 extends from the top of the seals 65 upwardly along the shaft 60 to a position adjacent platform 20 (FIG. 1) to an oil filler port and sight glass 7 providing a head of oil over the shaft seal 65 with sufficient head pressure so as to prevent the ingress of deliterious material to the sleeve bearing from the bottom of the bearing. The height of the oil column is such that the oil level pressure is greater than the internal pressure in the digester which depends on the job requirement. A wear sleeve 64 which may be ceramic coated extends from the bottom surface of bearing sleeve 62 to a seal plate or a labyrinth shield 66 to provide a tortious path for any particles seeking to enter into the bearing areas. Rotary oil seal means 65 of conventional construction is positioned between the lower periphery of shaft housing 13 and the outer periphery of the wear sleeve 64. Wear sleeve 64 is typically made of steel material and the ceramic coating may be METCO 450 prime and METCO 136-F top coat which is a chromium oxide/silica powder available from METCO, Inc., Westbury, N.Y., or other known composition.

The above construction of bearing and seal allows the lower bearing to be positioned juxtaposed immediately above the propeller hub thus providing maximum bearing support for the propeller and hub combination. This obviates having a long cantilevered shaft extending from a bottom lower bearing or placing the lower bearing submerged below the liquid level and above the propeller level and necessitating grease or sludge lubrication. Since digesters operate at pressures greater than atmospheric pressure the head of oil in the described bearing which is greater than the operating pressure of the digester prevents the flow of grit and other contaminating materials into the bearing. Likewise the oil prevents any water flushing out of the bearing during operation. The bearing is therefore submerged in oil all the time with minimal chance that sludge water or grit can enter and cause damage. As can be seen in FIG. 7 the shaft shield 13 is a pipe of smooth exterior from any flange above the liquid level down to the propeller hub. This eliminates any real possibilities of rags and strings building up and interfering with the pumpage rate. This is distinguished from prior art designs which incorporate flanges and associated bolts and grease lines below liquid level thus making ragging a real problem.

FIG. 8 shows a preferred mode of affixation of the propeller hub 43 to the shaft extension 59. The internal hub and propeller are placed in abutment with shield 66 and keyed to the shaft extension preventing radial displacement by placing a key in keyway 67*a* in the shaft extension. An adaptor bar 68 is threadedly connected to the bottom of shaft extension 67 and extends the interior length of hub 43. Threaded end 71 of bar 68 extends from the hub and a centering and locking nut 70 is threaded thereon. This nut centers the shaft 67 and adapter 68 within the bore of the hub 43 utilizing conical surface 72, acts to axially lock the propeller and hub combination against shield 66 and itself is locked in place from torsional movement when held in place by set screw 69 extending into the end periphery of hub 43.

The above description of embodiments of this invention is intended to be illustrative and not limiting. Other embodiments of this invention will be obvious to those skilled in the art in view of the above disclosure.

We claim:

1. In a draft tube mixer in flow connection to a solids and debris containing liquid-holding tank wherein a motor-driven shaft and propeller mounted to a hub on said shaft are mounted in a draft tube to pump liquid, solids and debris through said draft tube in one direction the improvement comprising:

a ragless propeller within said draft tube, said propeller having a series of lobed blades extending from said hub and symmetrically spaced and spirally disposed at varying diameter along a constant-diameter length of said hub, each of said blades spirally extending about 360° around said hub;

means including a blade leading edge regressing from a point of tangency at the shaft hub as said blades progress along said hub for outwardly deflecting debris striking said blades;

wherein each of said blades are faired into said hub at spaced apart positions on opposite ends of said hub and have a maximum diameter essentially midway of said spaced apart positions; and further comprising bearing means for supporting said shaft adjacent the attachment of said propeller to said shaft at a level within said draft tube at hydraulic pressure, said bearing means including a shaft housing, a bearing sleeve and means including an oil column within said shaft housing above and around said bearing sleeve pressurizing said bearing sleeve to a pressure greater than the hydraulic pressure in said draft tube at said level.

* * * * *

UNITED STATES PATENT AND TRADEMARK OFFICE

CERTIFICATE OF CORRECTION

PATENT NO. : 4,575,256

DATED : March 11, 1986

INVENTOR(S) : Jack R. Armitage et al.

It is certified that error appears in the above—identified patent and that said Letters Patent is hereby corrected as shown below:

Col. 1, line 21, delete "rotable" and insert --rotatable--.

Col. 3, line 27, delete "have" and insert --having--.

Col. 3, line 44, delete "volitile" and insert --volatile--.

Col. 3, line 44, after "acids" delete "assets".

Col. 4, line 27, delete "as a" and insert --as at--.

Col 4, line 47, delete "removes" and insert --remove--.

Col. 5, line 33, delete "in or" and insert --in, or,--.

Signed and Sealed this

*Ninth* Day of *September 1986*

[SEAL]

*Attest:*

DONALD J. QUIGG

*Attesting Officer*

*Commissioner of Patents and Trademarks*